United States Patent [19]

Murrill et al.

[11] Patent Number: 4,506,480

[45] Date of Patent: Mar. 26, 1985

[54] EXTENSIBLE BOOM CONSTRUCTION FOR SELF-PROPELLED AERIAL WORK PLATFORMS

[75] Inventors: William D. Murrill, Downey; Bryan Langseth, Whittier, both of Calif.

[73] Assignee: Calavar Corporation, Santa Fe Springs, Calif.

[21] Appl. No.: 474,050

[22] Filed: Mar. 10, 1983

[51] Int. Cl.[3] ..... E04H 12/34

[52] U.S. Cl. ..... 52/121; 182/2

[58] Field of Search ..... 52/118, 121, 117; 182/2

[56] References Cited

U.S. PATENT DOCUMENTS

| | | | |
|---|---|---|---|
| 4,133,411 | 1/1979 | Curb | 52/118 |
| 4,156,331 | 5/1979 | Lester et al. | 52/118 |
| 4,185,426 | 1/1980 | Prescott | 182/2 |
| 4,429,763 | 2/1984 | Houck | 182/2 |

*Primary Examiner*—James L. Ridgill, Jr.
*Attorney, Agent, or Firm*—Charles E. Wills

[57] ABSTRACT

An extensible boom assembly which has a tubular outer section, a tubular intermediate section and a tubular inner section supported in a telescoping relationship, and containing a flexible power conducting line which extends through the assembly from adjacent the forward end thereof to adjacent the rearward end thereof. An articulated, hollow link track member which is supported within the boom assembly and which has one end portion doubled-back upon itself, receives and protects the power conducting line from damage during the relative movement of the several boom sections.

6 Claims, 17 Drawing Figures

EXTENSIBLE BOOM CONSTRUCTION FOR SELF-PROPELLED AERIAL WORK PLATFORMS

BACKGROUND AND BRIEF SUMMARY OF THE INVENTION

This invention relates generally to self-propelled aerial work platforms and more particularly to an improved extensible boom therefor which has internally positioned hydraulic lines and electrical cables.

Self-propelled hydraulic boom lifts with elongate longitudinally extensible booms mounted thereon for controlled horizontal and vertical pivotal movement and for selective extension and contraction of the boom are old and well known in the art.

Extensible booms of the type under consideration have forward free ends and pivotally mounted rear ends. Such booms are generally made up of two or more elongate, telescopically engaged, tubular sections. The larger in cross-section or outer boom section commonly establishes the rear pivotally mounted end of the boom. The smallest in cross-ection or inner boom section establishes the front free end of the boom, with which work platforms or other work performing gear are related. The sections of the booms are (most commonly) driven longitudinally relative to each other by elongate, hydraulic cylinder and ram units arranged within and extending longitudinally of the boom sections. In those booms which include more than two sections, sheave and wire cable systems are connected with and between the sections which are driven by the cylinder and ram units and the sections which are not driven by those units, to effect desired relative axial shifting of all of the boom sections.

Boom lifts with extensible booms carrying work platforms at their forward free ends and which include manually operable control means at the platforms to enable workmen to effect desired operation of the booms, contain elongate, flexible hydraulic lines and electrical cables which extend from the platforms at the front ends of the booms to the rear ends of the booms to connect with related hydraulic and/or electric drive and control means provided to operate the booms and which are carried by the vehicles. In such boom lifts, the lines and cables must be sufficiently long to enable the booms to be extended to their maximum longitudinal extent. Accordingly, when the booms are not fully extended, the lines and cables are slack and extend loosely between the front and rear ends of the booms.

The aforesaid lines and cables have been difficult to handle and to protect against damage. Thus, when the subject lines and cables are arranged within their related boom structures, they interfere with other parts of the boom structures and are subject to being rapidly worn and otherwise damaged or destroyed. It has been learned that when such lines and cables are mounted on the exteriors of the boom structures, there is little that can be done to effectively protect them against damage by snow and ice and by engagement with trees and other like obstructions.

The prior art has made special efforts to provide means to effectively handle and protect the hydraulic lines and electrical cables which are associated with and which extend longitudinally of extensible booms. WHile some of those efforts have resulted in structures which provide improved handling and protection, those structures, for the most part, have their own shortcomings and present new problems which are often as serious and troublesome as are the problems they seek to reduce or eliminate.

With the foregoing limitations and deficiencies of known devices in mind, it is an object of the present invention to provide an elongate, longitudinally extensible boom structure having novel means within its interior for holding and protecting hydraulic lines and electrical cables extending from one end to the other of the boom structure as the sections thereof extend and contract.

Another object of our invention is to provide novel means for holding and protecting hydraulic lines and electrical cables within an extensible boom structure which is substantially unaffected by externally applied forces and external conditions such as snow and ice.

A further object of our invention is to provide novel means for holding and protecting hydraulic lines and electrical cables within an elongate boom comprised of telescopically engaged tubular boom sections, which includes an elongate articulated link conduit positioned within and extending longitudinally of the boom with opposite ends anchored to those boom sections which define the opposite ends of the boom and in and through which the lines and cables are laid and protected.

The foregoing and other objects and advantages of our invention will be apparent and fully understood from the following detailed description of one preferred form and embodiment of our invention, throughout which description reference is made to the accompanying drawings.

DETAILED DESCRIPTION OF THE INVENTION

Figures 1, 2, 16, 17:
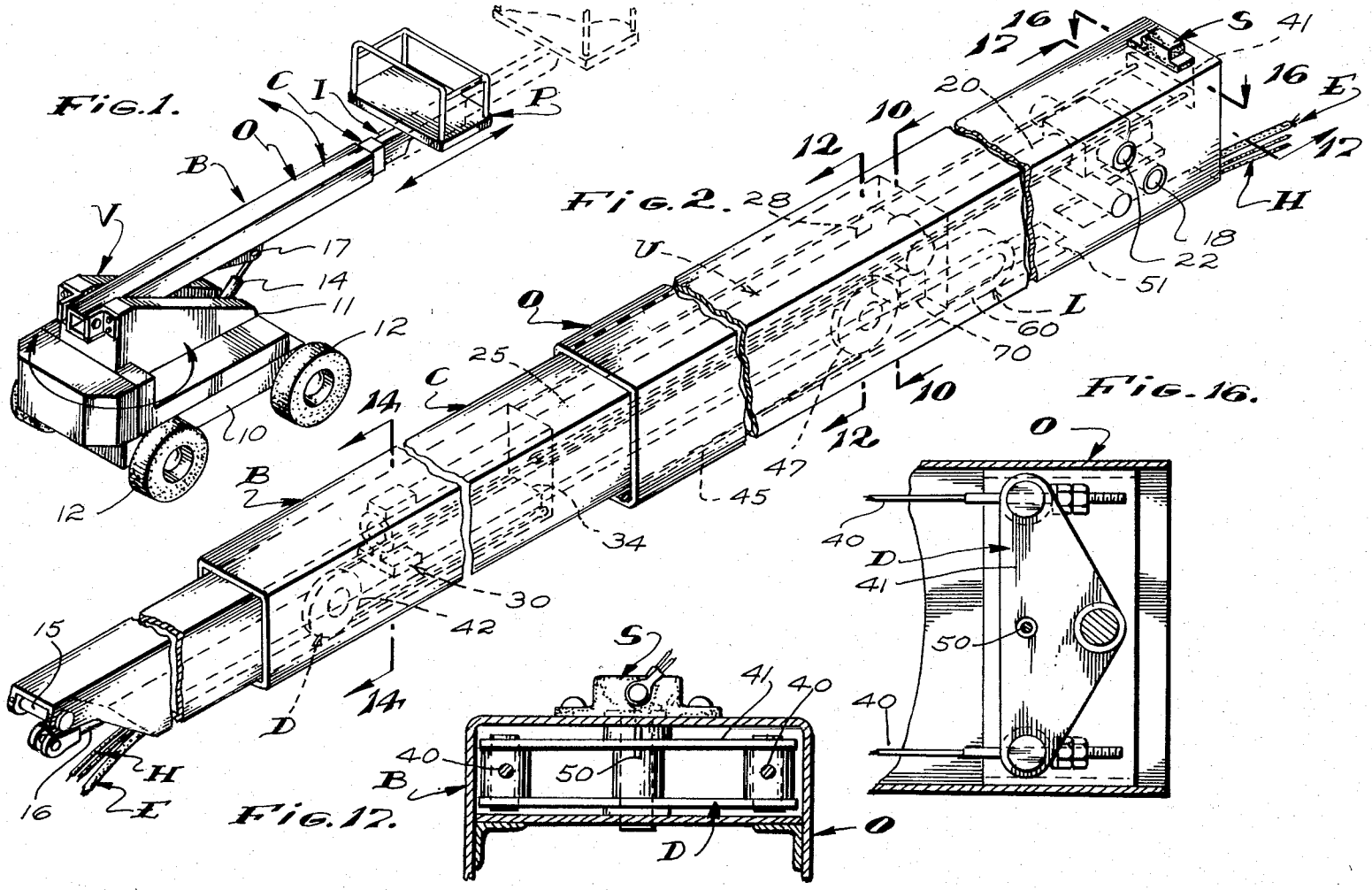
FIG. 1 is an isometric view of a self-propelled aerial work platform provided with an extensible boom embodying our invention.
FIG. 2 is an isometric view of an extensible boom constructed in accordance with the teachings of our invention.
FIG. 16 is an enlarged, fragmentary, horizontal sectional view taken substantially as indicated by line 16—16 on FIG. 2.
FIG. 17 is a fragmentary, vertical sectional view taken substantially as indicated by line 17—17 on FIG. 2.

Referring to FIG. 1 of the drawings more particularly by reference numerals and letters, the letter V identifies a selfpropelling aerial work vehicle provided with an extensible boom B embodying the teachings of the present invention. The boom B is shown in its retracted position in solid lines and in an extended position in broken lines. It is composed of three elongate, telescopically related sections, there being a rear outer boom section O, an intermediate central boom section C, and a front inner boom section I. The boom will be described as having a rear end (defined by the section O) mounted on the vehicle V, and a front end (defined by the section I) which supports a work platform P.

The vehicle V includes a frame or carriage 10 on which a turret 11 is rotatably mounted in a conventional manner. The turret 11 contains appropriate mechinery and support systems and/or means for operating the boom. The frame 10 is shown provided with two pairs of wheels 12.

The boom B is hydraulically actuated, both as to its effective length and as to its vertical disposition relative to the vehicle V. Vertical positioning of the boom is accomplished by means of a lift cylinder 14 suitably connected between the turret 11 and the outer section O of the boom. The front end of the boom, that is, the free end of the inner section I, is pivotally connected to the work platform P by means of a pin 15. By rotating the turret 11 relative to the frame 10, elevating the boom B by means of the lift cylinder 14 and by extending the boom B, the work platform P can be positioned as desired in a conventional manner.

Figures 3, 4, 5, 6, 7, 8, 9:
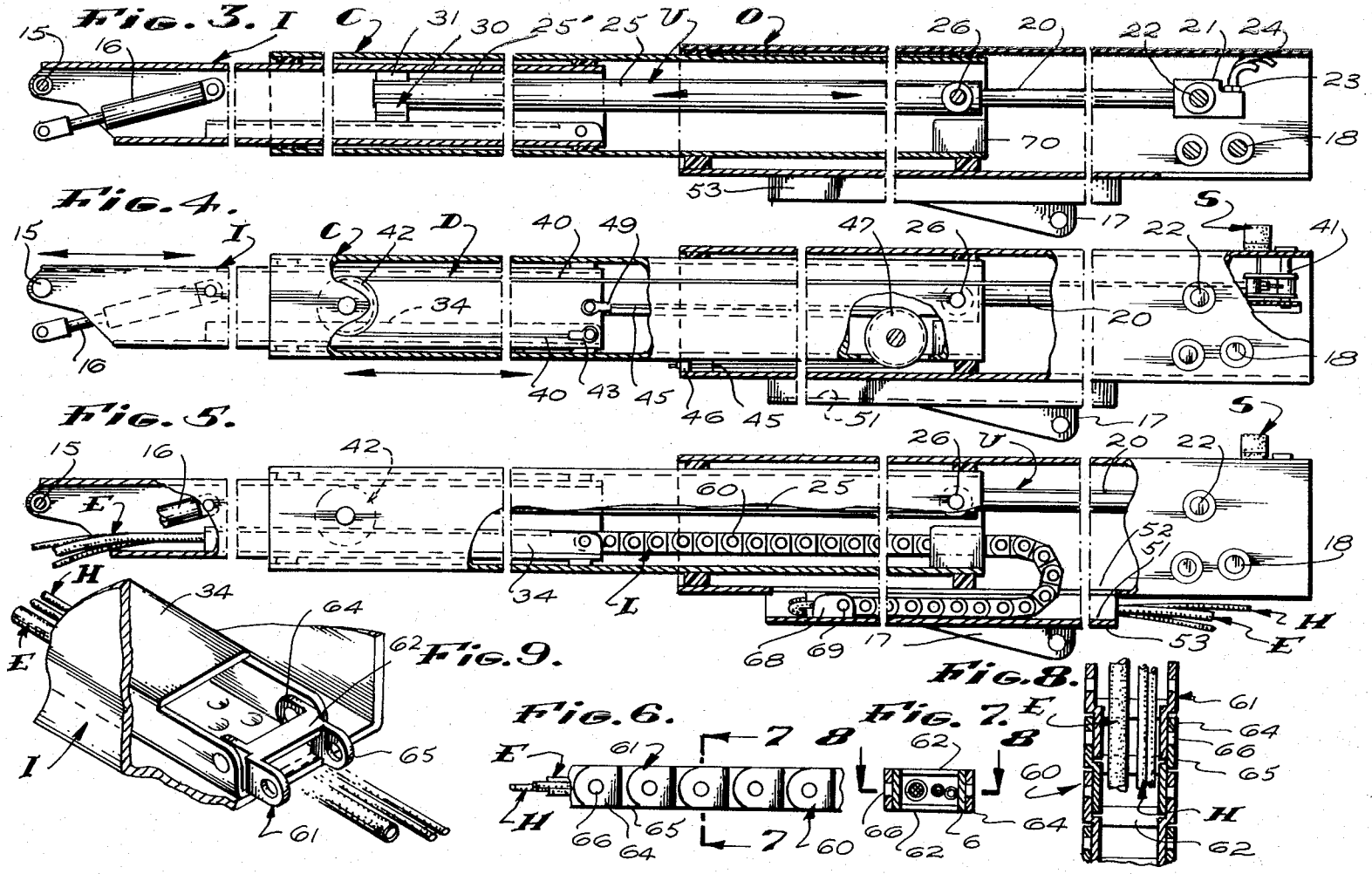
FIG. 3 is a diagrammatic longitudinal sectional view of the boom with selected parts and portions not shown, in order to best illustrate the hydraulic drive means.
FIG. 4 is a like diagrammatic longitudinal sectional view of the boom with selected parts and portions not shown, in order to best illustrate the sheave and wire cable drive means.
FIG. 5 is a like diagrammatic longitudinal sectional view of the boom with selected parts and portions not shown, in order to best illustrate the principal hydraulic lines and electrical cable handling means.
FIG. 6 is a fragmentary, side elevational view of a portion of the articulated link conduit.
FIG. 7 is a vertical sectional view taken as indicated by line 7—7 on FIG. 6.
FIG. 8 is a horizontal sectional view taken as indicated by line 8—8 on FIG. 7.
FIG. 9 is an enlarged fragmentary, perspective view of the end portion of the duct contained in the intermediate boom section as shown in FIG. 5.

As shown, in FIG. 3, the inner section I carries a slave cylinder 16 at its front end. The cylinder 16 is suitably connected with the work platform P and functions to maintain the platform P in level position in a conventional manner.

In accordance with common practice, the outer boom section O is provided with coupling brackets 17 (FIG. 3) to connect with the lift cylinder 14, and the rear end portion of the outer boom section O is provided with a mounting pin 18 (FIG. 3) to pivotally mount the rear end of the boom on the turret 11 of the vehicle V in a conventional manner.

The boom sections O, C and I are elongate tubular sections preferably formed of steel. The sections O, C and I have front and rear ends and will, for purposes of this disclosure, be described as being disposed horizontally and as having flat, vertical, laterally spaced side walls and flat, horizontal, vertically spaced top and bottom walls.

Figures 10, 11, 12, 13, 14, 15:
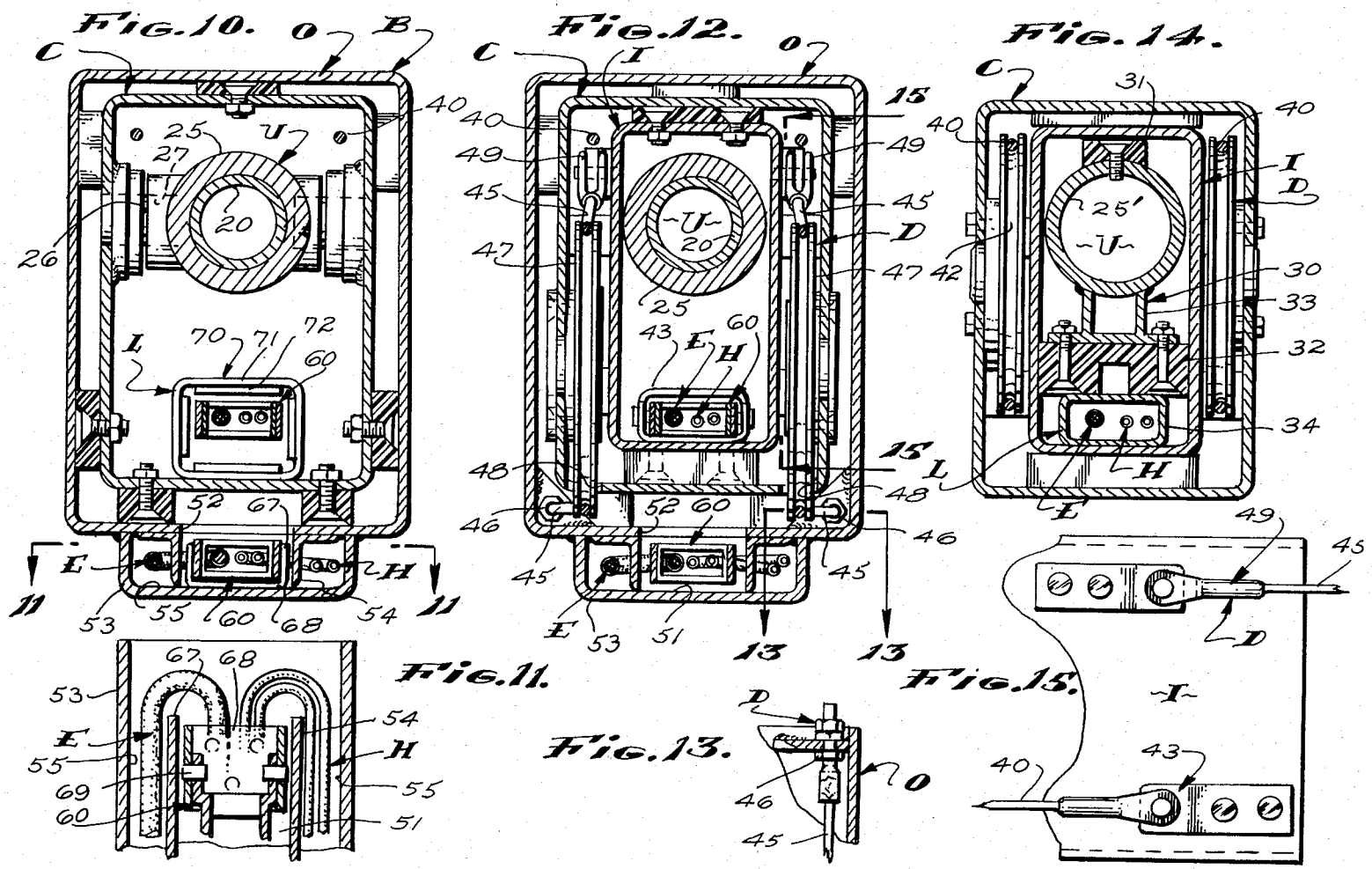
FIG. 10 is an enlarged vertical sectional view taken substantially as indicated by line 10—10 on FIG. 2.
FIG. 11 is a fragmentary, horizontal section view taken substantially as indicated by line 11—11 on FIG. 10.
FIG. 12 is an enlarged, vertical sectional view taken substantially as indicated by line 12—12 on FIG. 2.
FIG. 13 is a fragmentary, horizontal sectional view taken substantially as indicated by line 13—13 on FIG. 12.
FIG. 14 is an enlarged vertical sectional view taken substantially as indicated by line 14—14 on FIG. 2.
FIG. 15 is a fragmentary, vertical view taken substantially as indicated by line 15—15 on FIG. 12.

As shown in FIGS. 2 and 12, the outer section O is greater in vertical and lateral extent than the central Section C and the inner section I is less in vertical and lateral extent than the central section C. Accordingly, while the several sections are telescopically engaged, appreciable space occurs between the adjacent related walls thereof, as shown most clearly in FIGS. 10, 12 and 14.

In practice, and as shown, the several boom sections O, C and I are maintained centered and in alignment with each other by means of a multiplicity of strategically located bearings pads which form no part of this invention.

Extension of the boom B is accomplished by means of an elongate cylinder and ram unit U arranged within and extending longitudinally of the boom and by means of a sheave and cable drive means D within the boom structure, as best shown in FIGS. 3 and 4 of the drawings.

The cylinder and ram unit U includes an elongate fluid conducting ram 20 with a rear end mounted within the rear end of the outer rear section O and extending forwardly into the section C. The rear end of the ram 20 is connected with a mounting head 21 pivotally carried by a pair of laterally inwardly projecting trunions 22 carried by the side walls of the section O. The mounting head 21 is a fluid conducting structure and is provided with fittings 23 which connect with hydraulic fluid lines 24. The lines 24 extend from the rear end of the boom and connect with valve controlled fluid supply means (not shown) within the vehicle V.

The unit U next includes an elongate cylinder 25 slidably engaged on and about the ram 20 and extending longitudinally into the central boom section C. The rear end of the cylinder 25 is drivingly connected with the rear end of the section C by mounting means which includes a pair of laterally inwardly projecting trunions 26 carried by the side walls of the section C and engaged in laterally outwardly opening bearing openings 27 in blocks 28, formed on or secured to the cylinder (see FIGS. 2 and 10).

The cylinder 25 can extend forwardly through the central section C and into the inner Section I, or it can and is preferably provided with an elongate tubular extension 25′ which extends into the section I and which is provided with a support bearing means 30 at its front end. The support bearing means 30 slidably engages inner surfaces in the section I to support the front end of the cylinder and ram unit in desired axial alignment within the boom structure. In the form of the invention illustrated, the bearing means 30 includes a bearing pad 31 at the top of the extension 25′ to slidably engage the top wall of the section I and a bearing pad 32 carried by a mounting bracket 33 on the tubular extension 25′ and which engages the side walls of the section I and the top wall of a duct part 34 which is fixed to the bottom wall of the section I and which will hereinafter be described.

It is to be noted that the unit U only operates to move the central section C relative to the rear outer section O. The forward inner section I is moved relative to the section C upon movement of the section C relative to the section O by means of the sheave and cable drive means D.

The drive means D includes a pair of flexible wire cables 40, one at each side of the boom structure. Considering each cable 40 separately, each has a rear end connected with a related end of an elongate, laterally extending rocker bar 41 (FIG. 16) pivotally mounted in the upper rear portion of the rear outer section O. Each cable 40 extends forwardly from the rocker bar 41 through the section O and between opposing related side walls of the sections O and I and to the top of and about a front sheave 42 rotatably carried by the side wall of the section C at the front end portion thereof. The sheave 42 is rotatable about a horizontal transverse axis. The lower front end portion of the cable 40 extends rearwardly and is securely anchored to the inner section I adjacent the lower rear end thereof by a suitable terminal coupling structure 43 (see FIGS. 4 and 15). With the line 40 and sheave 42 arranged as shown, it will be recognized that when the section C and sheave 42 are moved forwardly relative to the rear outer section O, the lower front portion of the cable 40 extending between the sheave 42 and the rear end of the section I is shortened and the cable 40 pulls the section I forwardly and from the section C.

The means D next includes a pair of flexible retract wire cables 45, one at each side of the boom structure. Each cable 45 has a lower rear end anchored to the front end of the outer boom section O by a terminal coupling structure 46. The cable 45 extends rearwardly in the section O and engages the lower side of a rear sheave 47 at the rear end portion thereof. The sheave 47 is rotatably supported on the side wall of the section C adjacent the inner surface thereof on a horizontal transverse axis. The bottom wall of the section C adjacent the sheave 47 is provided with a slot-like opening 48 through which the lower portion of the sheave 47 freely extends to enter the space between the sections O and C and to engage the cable 45. The cable 45 extends up and forward about the sheave 47 and thence to the rear end of the forward inner section I where it is securely anchored by a suitable terminal coupling structure 49 similar to the coupling structure 43 and as best shown in FIG. 15.

With the retract cable 45 and rear sheave 47 arranged and related to the sections O, C and I as illustrated and described, it will be recognized that when the section C is moved rearwardly relative to the section O by the unit U, the cable 45 is drawn rearwardly by the sheave 46 and the cable pulls the inner section I rearwardly into the section C.

With the means D, the direction and extent of longitudinal movement of the inner section I relative to the central section C occurs at the same time and is equal in direction and extent with longitudinal movement of the section C relative to the section O (effected by the hydraulic unit U).

As previously mentioned, the boom structure B supports the work platform P, and in accordance with common practice the platform is provided with manually operable control means (not shown) to enable workmen supported on the platform to effect necessary and desired operation of the boom and the vehicle. The manually operable control means at the platform are connected with boom operating control device such as valves and switches mounted on the turret 11, by means of a plurality of flexible hydraulic lines and electrical cables which are arranged to extend longitudinally through and from the opposite ends of the boom. For purposes of this disclosure, we have shown two hydraulic lines or hoses H and a single electrical cable E having a plurality of electrical wires or conductors within it, extending through and from the opposite ends of the boom structure.

The lines H and the cable E are sufficiently long to extend through and from the ends of the boom when the boom is fully extended, and are greater in length than the boom when the boom is fully retracted. Accordingly, when the boom is fully retracted, the hydraulic lines and the electrical cable are slack within the boom, and if not suitably contained and controlled are subject to wearing by rubbing against the inner surfaces of the boom section and to becoming fouled in the sheaves and the extend and retract cables.

Accordingly, to contain and protect the hydraulic lines H and the electrical cables E within the boom structure, we provide a novel carrier assembly L which includes an elongate, longitudinally extending duct 34 within the forward end of the inner boom section I (FIG. 9). The duct 34 is shown as a sheet metal box section with a flat bottom wall fixed to the bottom wall of the inner section I as by spot welding 35, and has a flat top wall on which the support bearing means 30 at the forward end of the boom extension 25' is slidably engaged (see FIGS. 9, 12 and 14).

The carrier assembly L further includes a longitudinally extending, upwardly-opening trough 51 at the bottom wall of the outer boom section O (FIGS. 10 and 12). The trough 51 is established by an elongate slot 52 in the bottom wall of the section and an elongate, upwardly-opening channel section 53 positioned below and welded to the bottom wall of the section O, beneath the slot 52. It is to be particularly noted that the channel 53 is such that it reinforces and make the section O of the boom substantially stronger than that section would be if the channel were not made a part of it.

In the construction illustrated, the channel section 53 is substantially wider than the slot 52 and a pair of laterally spaced, longitudinally extending angle members 54 and fixed within the channel section to cooperate with the bottom wall thereof so as to provide a pair of longitudinally extending ducts 55, one at each side of the trough 51. The angle members 54 have upper horizontal flanges welded to the bottom wall of the section O laterally inwardly of the side walls of the channel section 53, and have vertical flanges aligned with and depending from the side edges of the slot 52 (FIGS. 10 and 12).

The carrier assembly L also includes an elongate, articulated link track member 60 which has the front end thereof connected with the rear end portion of the duct 34 in the inner section I of the boom (FIGS. 5 and 9). The rear end of the track member 60 terminates in and is fixed to the bottom of the trough 51 in the outer boom section O, adjacent the front end thereof. Thus, the track member 60 extends rearwardly from the inner boom section I, through the central boom section C, and rearwardly in the rear outer boom section O where it turns down and thence forwardly into and through the trough 51 to the forward end portion thereof where it is fixed or anchored (FIG. 5). It should be noted that the trough 51 retains the track member 60 in an axial extending position, and prevents it from wandering from side to side in the boom sections.

The articulated track member 60 (see FIGS. 6 through 9) is made of a plurality of like, interconnected links 61 with vertically spaced, laterally extending bars 62, and laterally spaced vertical sides which have flat, forwardly projecting apertured link plates 64 and flat, rearwardly projecting link plates 65. The link plates 65 occur on vertical planes offset laterally inwardly from the vertical planes on which the link plates 64 occur. The plates 65 are formed with laterally outwardly projecting pivot pins or posts 66. The pins 66 on the plates 65 of each unit engage in the apertures in the plates 64 of the next adjacent link. The assembly of links 61 establish an elongate, articulated open cage-like track member 60 which is substantially rigid in a horizontal plane and which is flexible vertically and capable of being turned back upon itslef along its central vertical plane.

As shown in FIG. 9, the link plates 64 of the foremost link 61 engage between the side walls of the forward duct 34 at the rear end of the duct 34, and the pins 66 thereof engage in openings formed in said side walls. The rear end portion of the top wall of the duct 34 is relieved to facilitate welding the duct 34 to the bottom wall of the boom section I and to facilitate connecting and disconnecting the duct 34 and the track member 60.

As shown in FIGS. 10 and 11, the apertured link plates 64 of the rearmost link 61 engage with laterally spaced vertical flanges 67 of a U-shaped anchor bracket 68. The anchor bracket 68 is spotwelded to the bottom wall of the channel 53 adjacent the forward end portion thereof and the related flanges and plates are pivotally connected by means of pins 69.

In practice, and as shown in FIGS. 5 and 10, a tubular guide 70 is provided at the rear end of the central boom section C to slidably receive the portion of the track member 60 exiting from the rear end of the section C above the trough 51, and to assure advancement of the track member 60 into the trough 51 as the inner section I and central section C move rearwardly relative to the outer section O. The guide 70 comprises a rectangular frame 71 fixed to the bottom wall of the section C, which is preverably provided with plastic bearing blocks 72 to slidably engage the track member 60 and to assure free longitudinal movement thereon.

As shown in FIGS. 5 and 11, the front ends of the hydraulic lines H and the electrical cable E are accessible at the front end of the boom section I, extend rearwardly through the forward duct 34, into and through the articulated track member 60, and into the trough 51. The lines and cable then turn laterally from the duct 51 and rearwardly through the ducts 55 at the sides of the trough 51.

It is important to note that the carrier assembly L and the fluid lines and electrical cable related thereto are not subjected to any notable externally applied forces which might adversely affect them. The only working of the lines and cable occurs where the articulated track member 60 turns down to lay in the trough 51 which the boom is retracted, or is lifted up and out of the trough 51 when the boom is extended.

Articulated link tracks of the general type illustrated and described above are commercially produced and are available in several different sizes and models which can be effectively used in carrying out our invention.

Having illustrated and described but one typical preferred form and embodiment of our invention, we do not wish to be limited to the specific details herein set forth but wish to reserve to ourselves and modifications and/or variations that might appear to those skilled in the art and which fall within the scope of the following claims:

We claim:

1. An axially extensible boom assembly, comprising:

a tubular outer boom section, a tubular intermediate boom section, and a tubular inner boom section supported in a telescoping relationship and movable between a retracted position and an extended position and providing a forward end portion and a rearward end portion of the boom assembly;

power means interconnected with the boom sections for moving the intermediate boom section within and relative to the outer boom section and for moving the inner boom section within and relative to the intermediate boom section;

at least one elongate, flexible power conducting line extending through the boom assembly and accessible adjacent the forward and rearwards ends thereof; and an articulated, hollow track member extending axially within the boom section, which receives and guards said power conducting line from damage during relative movement of the boom sections, the forward end of the track member being fastened to the inner boom section and the rear portion of the track member being doubled-back in the forward direction with the rear end thereof fastened to the outer boom section, whereby when the assembly is moved to the retracted position the amount of said doubling-back is increased and when the assembly is moved to the extended position the amount of the doubling-back is decreased.

2. An axially extensible boom assembly as described in claim 1, which further includes an axially extending trough which is supported on and which depends from the lower portion of the outer boom section and which receives said rear portion of the track member which is doubled-back in the forward direction.

3. An axially extensible boom assembly as described in claim 1, which further includes an axially extending conduit fastened in the inner boom section for receiving the power conducting line, and which extends from the forward end of the track member to adjacent the forward end of the inner boom section.

4. An axially extensible boom assembly as described in claim 1, which further includes:

an axially extending trough which is supported on and which depends from the lower portion of the outer boom section and which receives said rear portion of the track member which is doubled-back in the forward direction; and an axially extending conduit fastened in the inner boom section for receiving the power conducting line, and which is in axially alignment with and extends from the forward end of the track member to adjacent the forward end of the inner boom section.

5. An axially extensible boom assembly as described in claim 2, which further includes elongate, spaced-apart, walls in a portion of the trough to provide a conduit on each side of the hollow track member which is received in the trough.

6. An axially extensible boom assembly as described in claim 5, in which said walls are provided by angle members which have a vertically disposed flange portion and a horizontally disposed flange portion and in which the horizontally disposed flange portion is fastened to the outer boom section.

* * * * *